US007410168B2

(12) United States Patent
Gumina

(10) Patent No.: US 7,410,168 B2
(45) Date of Patent: Aug. 12, 2008

(54) POKER STYLE SCRATCH-TICKET LOTTERY GAMES

(75) Inventor: Anthony G. Gumina, Las Vegas, NV (US)

(73) Assignee: Scientific Games International, Inc., Newark, DE (US)

( * ) Notice: Subject to any disclaimer, the term of this patent is extended or adjusted under 35 U.S.C. 154(b) by 289 days.

(21) Appl. No.: 11/210,312

(22) Filed: Aug. 24, 2005

(65) Prior Publication Data

US 2006/0043669 A1 Mar. 2, 2006

Related U.S. Application Data

(60) Provisional application No. 60/605,795, filed on Aug. 31, 2004, provisional application No. 60/605,290, filed on Aug. 27, 2004.

(51) Int. Cl.
*A63F 3/06* (2006.01)
*A63F 1/00* (2006.01)

(52) U.S. Cl. ..... 273/139; 273/292; 273/274; 283/901; 283/903

(58) Field of Classification Search ..... 273/139, 273/138.1, 292, 274, 138.2; 283/901, 903; 463/13

See application file for complete search history.

(56) References Cited

U.S. PATENT DOCUMENTS 1,527,929 A 2/1925 Simons
3,089,123 A 5/1963 Hennis et al.
3,245,697 A 4/1966 Nugent
3,699,311 A 10/1972 Dunbar
3,736,368 A 5/1973 Vogelman et al.
3,826,499 A 7/1974 Lenkoff
3,868,057 A 2/1975 Chavez
3,876,865 A 4/1975 Bliss
3,902,253 A 9/1975 Sabuzawa et al.
3,918,174 A 11/1975 Miller et al.
3,922,529 A 11/1975 Orloff
3,934,120 A 1/1976 Maymarev
4,017,834 A 4/1977 Cuttill et al.
4,095,824 A 6/1978 Bachman (Continued)

FOREIGN PATENT DOCUMENTS

AU B-18428/92 12/1992

(Continued)

OTHER PUBLICATIONS

Webcraft's "Hold 'em Poker", Webcraft Games, Inc., Received in the PTO Jun. 4, 1999.*

(Continued)

*Primary Examiner*—Benjamin H Layno
(74) *Attorney, Agent, or Firm*—Dority & Manning, P.A.

(57) ABSTRACT

A lottery instant win game card simulating a Hold'Em Poker styled card game with multiple chances of winning for a player. The instant game card includes at least two sets of player hands and at least two sets of opponent hands, with at least two sets of community cards, and at least two prizes. The player can combine one set of the player hands with either set of community cards to form a strongest hand for that set of player hands. The strongest player hand is compared against the strongest opponent hand. If the player wins, the player wins the prize associated with that winning player hand.

10 Claims, 4 Drawing Sheets

U.S. PATENT DOCUMENTS

| | | | |
|---|---|---|---|
| 4,105,156 | A | 8/1978 | Dethloff |
| 4,176,406 | A | 11/1979 | Matkan |
| 4,191,376 | A | 3/1980 | Goldman et al. |
| 4,194,296 | A | 3/1980 | Pagnozzi et al. |
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumber |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | Dire et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,244 | A | 12/1989 | Klinge |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnson et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A | 8/1994 | Heidel et al. |
| 5,342,049 | A | 8/1994 | Wichinsky et al. |
| 5,344,144 | A | 9/1994 | Canon |
| 5,346,258 | A | 9/1994 | Behn et al. |
| 5,380,007 | A | 1/1995 | Travis et al. |
| 5,393,057 | A | 2/1995 | Marnell, II et al. |
| 5,401,024 | A | 3/1995 | Simunek |
| 5,401,541 | A | 3/1995 | Simunek |
| 5,403,039 | A | 4/1995 | Borowski, Jr. et al. |
| 5,407,199 | A | 4/1995 | Gumina |
| 5,420,406 | A | 5/1995 | Izawa et al. |
| 5,432,005 | A | 7/1995 | Tanigami et al. |
| 5,451,052 | A | 9/1995 | Behm et al. |
| 5,456,465 | A | 10/1995 | Durham |
| 5,456,602 | A | 10/1995 | Sakuma |
| 5,471,039 | A | 11/1995 | May |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlien et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beatty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| RE35,864 | E | 7/1998 | Weingardt |
| 5,779,840 | A | 7/1998 | Boris |
| 5,789,459 | A | 8/1998 | Inagaki et al. |

| | | | |
|---|---|---|---|
| 5,791,990 | A | 8/1998 | Schroeder et al. |
| 5,797,794 | A | 8/1998 | Angell |
| 5,803,504 | A | 9/1998 | Deshiens et al. |
| 5,816,920 | A | 10/1998 | Hanai |
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz et al. |
| 5,836,086 | A | 11/1998 | Elder |
| 5,836,817 | A | 11/1998 | Acres et al. |
| 5,848,932 | A | 12/1998 | Adams |
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawandy et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Shneier et al. |
| 5,979,894 | A | 11/1999 | Alexoff |
| 5,996,997 | A | 12/1999 | Kamille |
| 5,997,044 | A | 12/1999 | Behm et al. |
| 6,003,307 | A | 12/1999 | Naber et al. |
| 6,004,207 | A | 12/1999 | Wilson, Jr. et al. |
| 6,004,208 | A | 12/1999 | Wilson, Jr. et al. |
| 6,007,162 | A | 12/1999 | Hinz et al. |
| 6,012,982 | A | 1/2000 | Piechowiak et al. |
| 6,014,819 | A | 1/2000 | Maddix et al. |
| 6,017,032 | A | 1/2000 | Grippo et al. |
| 6,024,641 | A | 2/2000 | Sarno |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker et al. |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,220,596 | B1 | 7/2003 | Walker et al. |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,875,105 | B1 | 4/2005 | Behm et al. |
| 6,929,186 | B2 | 8/2005 | Lapstun |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0114210 | A1 | 6/2003 | Meyer et al. |
| 2004/0076310 | A1 | 4/2004 | Hersch et al. |
| 2004/0173965 | A1 | 9/2004 | Stanek |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0259631 | A1 | 12/2004 | Katz et al. |
| 2004/0266514 | A1 | 12/2004 | Penrice |

FOREIGN PATENT DOCUMENTS

| | | | |
|---|---|---|---|
| AU | B-21070/92 | | 7/1993 |
| AU | A-50327/96 | | 2/1997 |
| AU | B-52499/96 | | 2/1997 |
| AU | 199716432 | B2 | 9/1997 |
| AU | A-45403/97 | | 4/1998 |
| AU | A-63553/98 | | 10/1998 |
| DE | 2938307 | C2 | 4/1981 |
| DE | 3035898 | A1 | 4/1982 |
| DE | 3035947 | A1 | 5/1982 |
| DE | 2938307 | C3 | 6/1982 |
| DE | 29803107 | U1 | 8/1988 |
| DE | 3822636 | A1 | 1/1990 |
| DE | 2938307 | C3 | 8/1990 |
| DE | 3822636 | A1 | 1/1992 |
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 19751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |

| | | | |
|---|---|---|---|
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 3/1989 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |

OTHER PUBLICATIONS

'Are You In?', (Article).

'Beginner's Guide-How To Bet', (www. plimico.com/How+to+wager/beginnersguide/). (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article),1995, 1998, 10 Pgs., (http://conielco.com/faq/keno.html).

'Horse betting Tutorial-Types of Bets' (www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994, 2 Pgs., Issue 07431791, Boston Globe, Boston, MA.

'Maryland Launches Let It Ride', (Internet Article), Circa 2001, 1 Pg.

'Notice of Final Rulemaking', (Internet Article) Mar. 24, 2000, 10 Pgs., vol. 6, Issue #13, Arizona Administrative Register, Arizona.

'How To Play Megabucks', (Internet Article), Mar. 9, 2001, 2 Pgs., Oregon Lottery Megabucks,(http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article),Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn To Play the Races' (Internet Article), 15 Pgs., Racing Daily Form (www.drf.com).

Mike Parker, 'The History of Horse Racing' (Internet Article),1996, 1997,1998, 5 Pgs., http://www.mrmike.com/explore/hrhist.htm.

* cited by examiner

POKER STYLE SCRATCH-TICKET LOTTERY GAMES

CROSS REFERENCES TO RELATED APPLICATIONS

This application claims the benefit of U.S. Provisional Patent Application Ser. No. 60/605,290, titled "Poker Style Scratch Ticket Lottery Games," filed on Aug. 27, 2004, and U.S. Provisional Patent Application Ser. No. 60/605,795, titled "Scratch Ticket Lottery and Promotional Games," filed on Aug. 31, 2004, the entirety of which are incorporated herein by this reference.

BACKGROUND OF THE INVENTION

1. Field of the Invention

The present invention generally relates to lottery tickets and instant-win games and, more specifically, to a scratch ticket instant lottery game that generally simulates Texas Hold'em Poker.

2. Description of the Related Art

Lottery games and instant games, whether run by governmental or private entities, have proven to be quite popular, and go back some time in history. Participation in a game gives a person a chance to win a cash or a merchandise prize while also allowing private parties and lottery authorities to collect monies for public or charitable purposes. When taxed, the sales from games also provide additional revenue to state and city governments.

Instant lottery games are generally based on revealing predetermined game symbols, the games having a pre-determined outcome based on the programmed game parameters. Profitable these games may be, they are not always interesting to play. In order to new lottery game attract players, therefore, different themes have been developed for instant win lottery games. One of the examples of a game with a card game theme is Texas Hold'Em poker game as disclosed by the U.S. Pat. Nos. 5,407,199 and 6,435,500 B2. However, the games disclosed by these patents are mostly interactive games in which a set of three hands are displayed to a player, who will choose one of the hands to play. After choosing one hand to play, a corresponding set of community cards is revealed. If the player has chosen the set of community cards that provides him with the highest possible choice, the player wins the corresponding prize. The player does not play against an opponent and the chance of winning is one out of three.

Accordingly, it is desirous to have an instant win Texas Hold'Em styled poker lottery game that is easy to play and which presents some challenge to the player. Such game could additionally provides more chances to win. It is thus to such a game that the present invention is primarily directed.

SUMMARY OF THE INVENTION

In one embodiment, the invention comprises a method for playing an instant win lottery game. The method includes the steps of displaying a first set and a second set of community game elements to a player on a scratch-off instant win lottery ticket, displaying a first set and a second set of player game elements to the player, and displaying a first set and a second set of opponent game elements to the player. Each set of community game elements includes five game elements, with each set of player game elements including two game elements, and each set of opponent game elements including two game elements. The method further includes the steps of determining a first highest player winning set for the player based upon the potential combination of the first set of player game elements and the first set and the second set of community game elements, thus determining a first highest opponent winning set for an opponent based upon the potential combination of the first set of opponent game elements and the first set and the second set of community game elements, then determining a second highest player winning set for the player based upon the potential combination of the second set of player game elements and the first set and the second set of community game elements. Then the method includes the step of determining a second highest opponent winning set for an opponent based upon the potential combination of the second set of opponent game elements and the first set and the second set of community game elements, determining if either the first highest player winning set, the second highest player winning set, or both are winners, and determining a prize for the player, if either the first highest player winning set, the second highest player winning set, or both are winners.

In another embodiment, the invention comprises a method for making a scratch-off instant game card. The method includes the steps of placing a first set and a second set of community game elements on a game card, placing a first set and a second set of player game elements on the game card, placing a first set and a second set of opponent game elements on the game card, and covering the first set and second set of community game elements, the first set and second set of player game elements, and the first set and second set of opponent game elements. Each set of community game elements includes five game elements, each set of player game elements includes two game elements, and each set of opponent game elements includes two game elements.

In yet another embodiment, the invention comprises a scratch-off instant game card. The scratch-off instant game card includes a first set and a second set of community game elements, a first set and a second set of player game elements, and a first set and a second set of opponent game elements. Each set of community game elements includes five game elements, each set of player game elements includes two game elements, and each set of opponent game elements includes two game elements.

The present invention is therefore advantageous because it provides an attractive game for players of scratch off lottery game that includes the strategic elements of poker. Such a game and associated play style maintain player interest, yet is not too difficult so as to discourage players, and can use win or lose symbols for those who do not understand the rules of poker.

Other aspects and features of the invention will become apparent after review of the hereinafter set forth in the following Brief Description of the Drawings, Detailed Description of the Invention, and the claims.

DETAILED DESCRIPTION OF THE INVENTION

The rules for the playing card game of Texas Hold'em Poker game are simple. A player makes his or her best poker hand out of seven cards (game elements), with two cards in the player's hand and the other five community cards on the table. Thus, all players still in the game use three or more of the community cards to make their best hands. The player with the strongest hand wins. The card game starts with the dealer dealing two cards face down to each player, and a round of betting commences. After all bets, raises, and folds are completed, the first three community cards are dealt. The first three community cards are turned up all at once and are called "the flop." The flop is often the turning point in the game, determining who will remain in the game to see the last two cards. A round of betting occurs immediately after the flop. Most players fold their hand if the flop does not fit well with their game hand. The fourth community cards is called "the turn." As in previous plays, bets are placed. Finally, the fifth and final community card is turned over. This card is commonly called "the river." The last round of betting is complete then the players turn over their cards, and the player with the highest ranking poker hand wins.

This invention is directed to the implementation of a Texas Hold'Em styled poker instant lottery game, preferably on a scratch-off ticket. Because of limitations of being an instant game, the rules of the known styles of Texas Hold'Em poker games need to be altered, and in particular for use as a predetermined lottery game card or ticket. In one embodiment of the invention, there are two cards in the player's hand, two cards in the opponent's hand, and five community cards that are all printed on an instant game card in known fashion, and the player can uncover them, by scratching off a known type of a latex or elastomeric coating, in any desired order. After all nine cards of one instant game hand are uncovered, the highest ranking poker hand for the player is compared with the highest ranking poker hand for the opponent and the player wins if his highest ranking poker hand beats the opponent's highest ranking poker hand, in accord with the poker rules governing Texas Hold'Em.

In an alternative embodiment, the rules of the Texas Hold'Em poker game are further modified to make the game more interesting to the players. In this embodiment, there are two sets of player's hand, two sets of opponent's hand, and two sets of community cards in each game. After all the game cards are uncovered, there are two highest ranking poker hands for the player, one for each set of player's hand, and two highest ranking poker hands for the opponent, one for each set of opponent's hand. Besides having a doubling of the chances of forming a highest ranking poker hand for each set of player's hand, the player has two chances of winnings, one with each set of player's hands.

Figure 1:
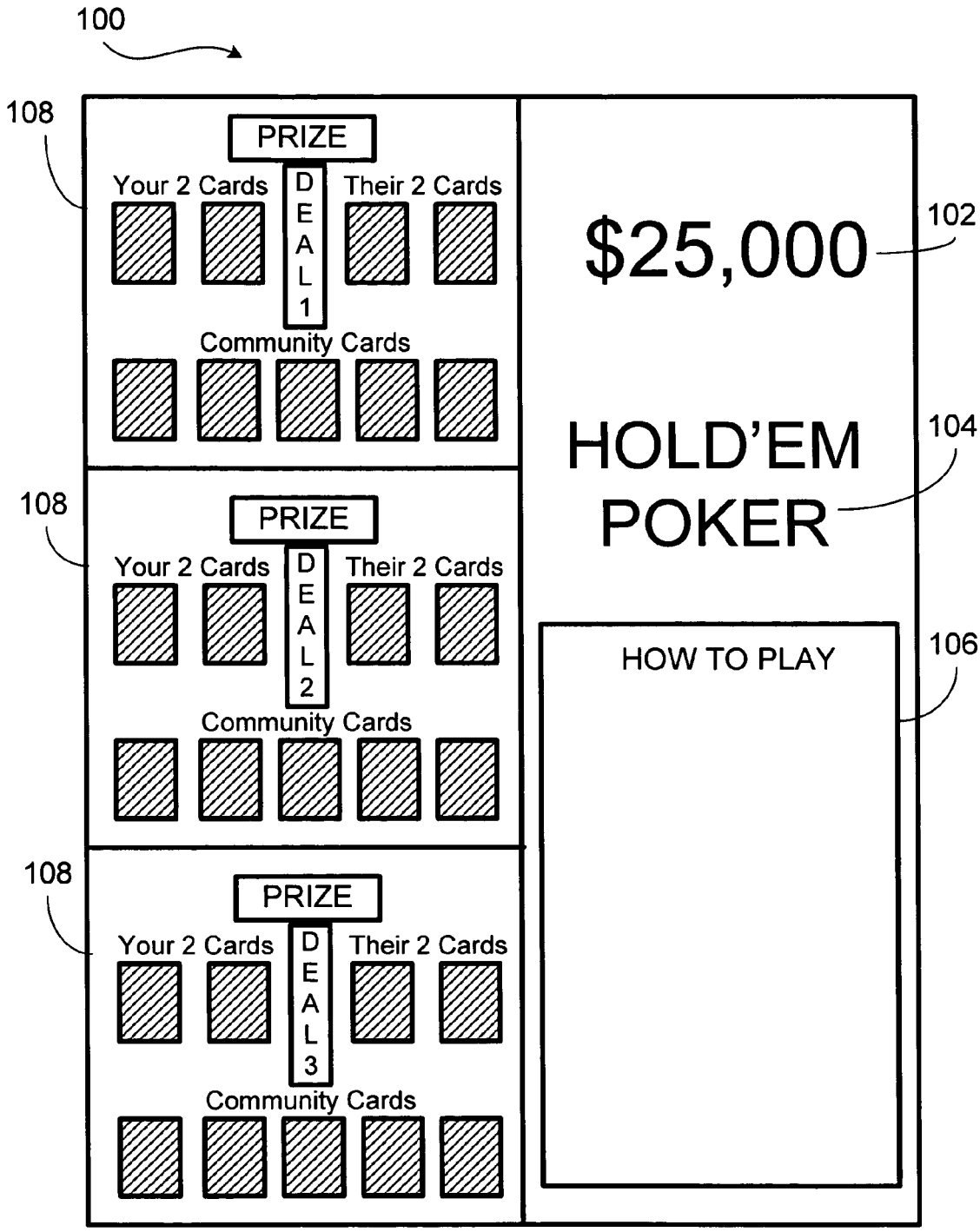
FIG. 1 illustrates one embodiment of an instant game ticket according to the invention.

FIG. 1 shows an instant Texas Hold'em Poker game card 100, printed in known fashion, according to one embodiment of the invention. On game card 100, there is shown three instant games 108, where each instant game has two player game cards (labeled as "your 2 cards"), two opponent game cards (labeled as "their 2 cards"), five community cards, and a prize indicia. When a player buys one instant game card 100, he is entitled to play all three instant games. Each game is played independently from the other two games; therefore, the player has three chances to win. Those skilled in the art will appreciate the number of instant games provided on a single instant win lottery game card may vary, as desired. The instant game card 100 may also include other information such as the grand prize 102, the name of the game 104, and game instructions 106. The prize indicia of each instant game may vary depending on the possibility of each winning hand. For example, the prize for a royal flush may be the grand prize 102 itself, and smaller prizes may be assigned for other winning hands.

The instant game card shown on FIG. 1 is formed of a substrate, which may comprise a paper or card stock, with desired image fields printed thereon and also having at least one, and sometimes several, game indicia areas on or in which the game play indicia (game elements) are selectively imaged, as known. The imaged data is covered by a removable elastomeric material, commonly referred to by those skilled in the art as "latex," which material may be removed by being rubbed or "scratched" off to reveal the underlying game indicia. Moreover, the imaged game indicia, once covered by the latex, may then have additional graphic images printed thereover, as known in the art. The instant game cards may also be manufactured with anti-counterfeiting features, such as the use of Benday patterns and other features known in the art.

Figure 2:
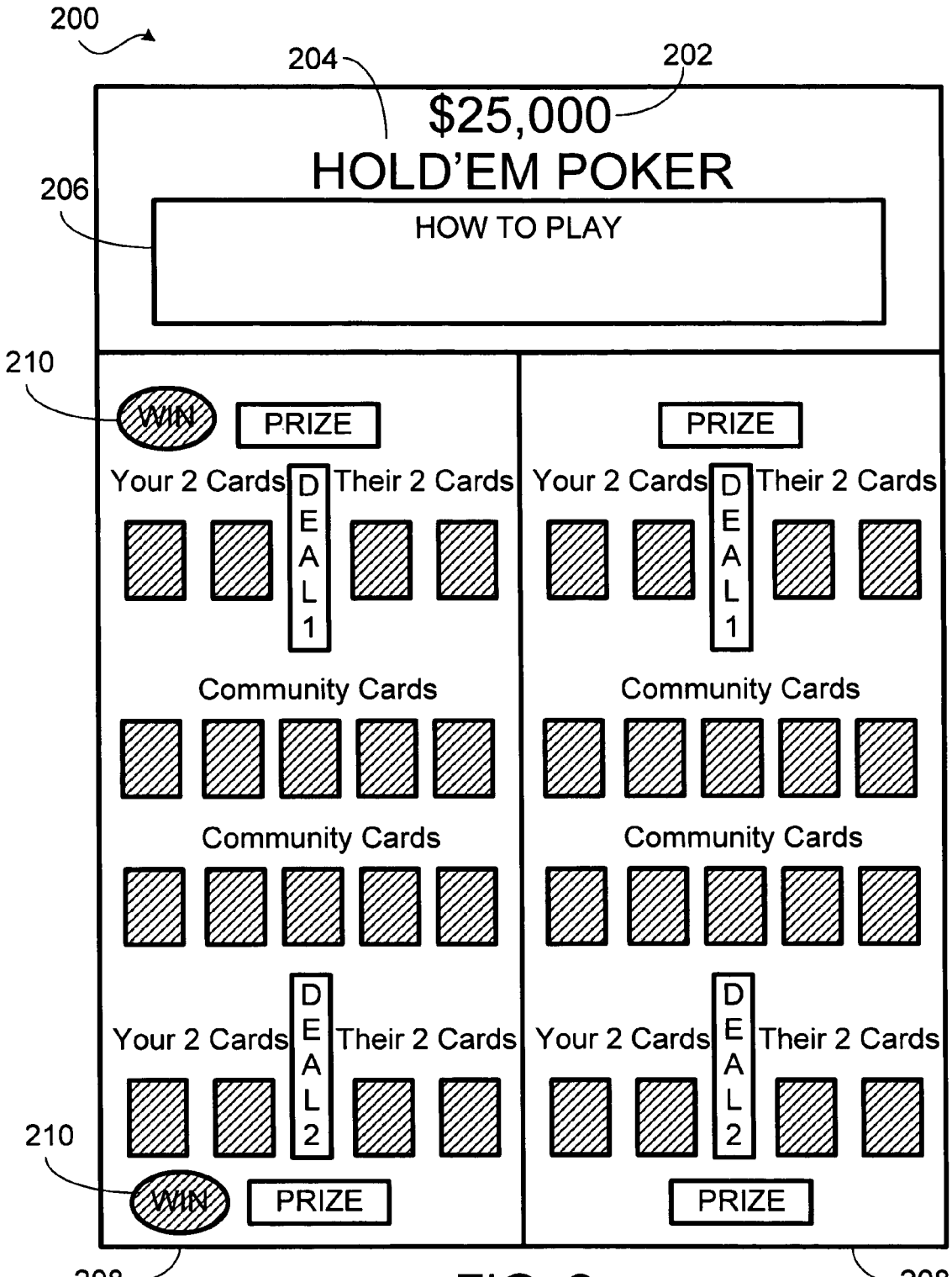
FIG. 2 illustrates an alternative embodiment of an instant game ticket according to the invention.

FIG. 2 is an alternative embodiment of a lottery instant win game card 200. Two games 208 are shown on one instant game card 200. Again, those skilled in the art will appreciate that any number of instant games may be placed on a single game card 200. For each game, the player plays two hands against two opponent's hands using two set of community cards. Each player hand is associated with a prize. If the player has winning hands against each of the opponent hands, the player will win all four prizes on the instant game card.

Figure 3:
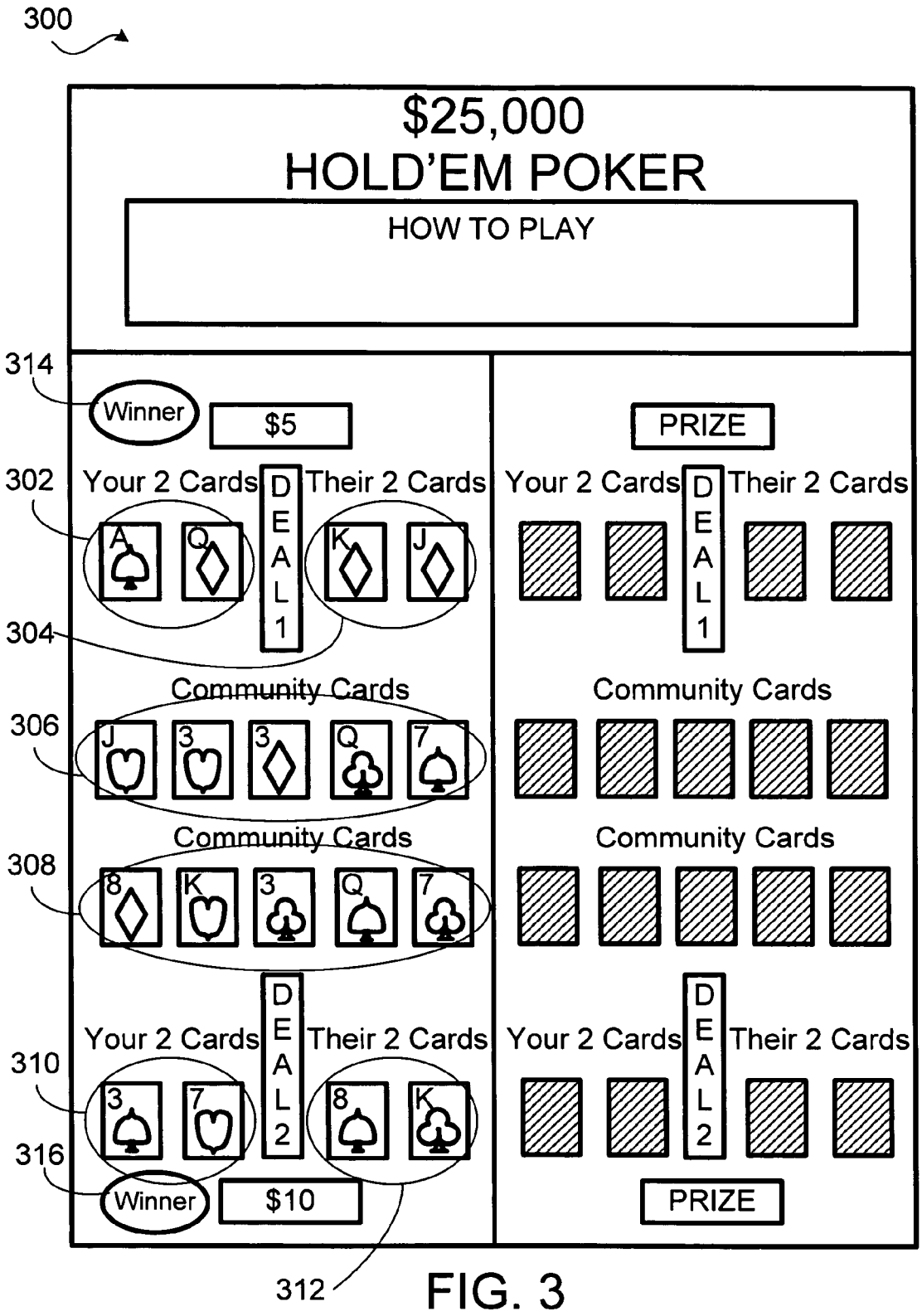
FIG. 3 illustrates one instant game ticket with game elements scratched off.

FIG. 3 illustrates one game of FIG. 2 with all game elements uncovered. The player has two sets of player's hands 302, 310, and the opponent has two sets of opponent's hands 304, 312. There are also two sets of community cards 306, 308 and two prizes 314, 316. In this example, four player hands are formed in the following way:

First hand: combining the player hand 302 with three game cards selected from the first set of community cards 306 that forms the highest ranking poker hand from this combination, which is two pairs (a pair of queens and a pair of threes)—DQ, CQ, HA, H3, D3, where D represents a diamond, C represents a club, and H represents a heart.

Second hand: combining the player hand 302 with three game cards selected from the second set of community cards 308 that forms the highest ranking poker hand from this combination, which is a pair of queens—DQ, HQ, HA, X, X, where X represents a don't care condition.

Third hand: combining the player hand 310 with three game cards selected from the first set of community cards 306 that forms the highest ranking poker hand from this combination, which is a full house (triple threes and a pair of sevens)—S3, H3, D3, H7, S7, where S represents a spade.

Fourth hand: combining the player hand 310 with three game cards selected from the second set of community cards 308 that forms the highest ranking poker hand from this combination, which is two pairs (a pair of threes and a pair of sevens)—H7, C7, S3, C3.

The four opponent hands in FIG. 3 are formed in the following way:

First hand: combining the opponent hand 304 with three game cards selected from the first set of community cards 306 that forms the highest ranking poker hand from this combination, which is two pairs (a pair of jacks and a pair of threes)—DJ, HJ, H3, D3, X.

Second hand: combining the player hand 304 with three game cards selected from the second set of community cards 308 that forms the highest ranking poker hand from this combination, which is a pair of kings—DK, HK, DJ, X, X.

Third hand: combining the player hand 312 with three game cards selected from the first set of community cards 306 that forms the highest ranking poker hand from this combination, which is a pair of threes—H3, D3, S8, CK, X.

Fourth hand: combining the player hand 312 with three game cards selected from the second set of community cards 308 that forms the highest ranking poker hand from this combination, which is two pairs (a pair of kings and a pair of eights)—CK, HK, S8, D8, X.

In the example illustrated in FIG. 3, the highest player hand for the set 302 is two pairs (queens and threes) and the highest opponent hand for the set 304 is two pairs (jacks and threes), and the player wins. On the same instant game card, the player hand for the set 310 is full house and the highest opponent hand for the set 312 is two pairs (kings and eights), and the player wins again. As it is shown, the player wins twice with one single game and wins the combined prize of $15. When a single game card incorporates two games as shown in FIGS. 2 and 3, the winner will have four chances to win. Those of ordinary skill in the art will recognize that the prize associated with each set of player hand can be varied according to the predetermined game prize table and associated probability distributions of the initial hands and the sets of community cards, and the mathematical expectation of the total prize payout.

Alternatively, the game card 200 may also includes a win/loss indicator 210 associated with each player set, which, when uncovered, will indicate whether the associated player set is a winner. In FIG. 3, two win/loss indicators 314, 316 are both uncovered and indicating each corresponding player set is a winner. By using the win/loss indicator 210, it will make easier for those players who are not familiar with the rules of the game to play the instant game. Those skilled in the art will appreciate other ways of making known to a player that he has a winning hand.

Figure 4:
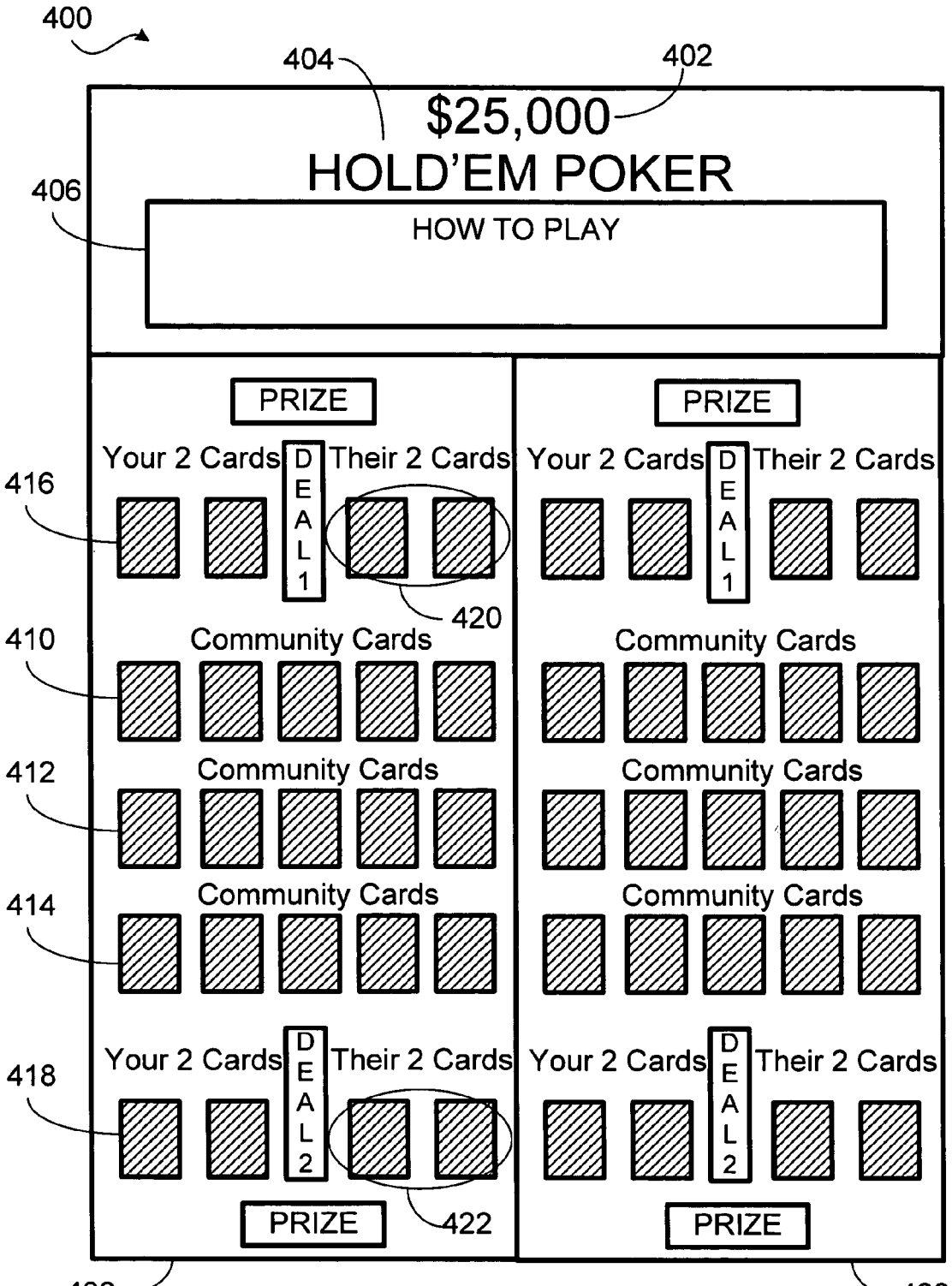
FIG. 4 illustrates an alternative embodiment of the invention.

FIG. 4 illustrates an alternative embodiment 400 of the invention. In the game 408, there is shown three sets of community cards, 410, 412, 414, that can be combined with two sets of player sets of player hands, 416, 418, or two sets of opponent hands, 420, 422. With the additional set of community cards, the player will have more chances of forming stronger hands, and thus increasing the odds of winning. Those skilled in the art will appreciate different number of community card sets can be placed on each game.

While the invention has been particularly shown and described with reference to one embodiment thereof, it will be understood by those skilled in the art that various changes in form and detail may be made without departing from the spirit and scope of the present invention as set forth in the following claims. Furthermore, although elements of the invention may be described or claimed in the singular, the plural is contemplated unless limitation to the singular is explicitly stated.

What is claimed is:

1. A method for playing an instant win lottery game, comprising the steps of:

displaying a first set and a second set of community game elements to a player on a scratch-off instant win lottery ticket, each set of community game elements including five game elements;

displaying a first set and a second set of player game elements to the player on the scratch-off instant win lottery ticket, each set of player game elements including two game elements;

displaying a first set and a second set of opponent game elements to the player on the scratch-off instant win lottery ticket, each set of opponent game elements including two game elements;

determining a first highest player winning set for the player based upon the potential combination of the first set of player game elements and the first set and the second set of community game elements;

determining a first highest opponent winning set for an opponent based upon the potential combination of the first set of opponent game elements and the first set and the second set of community game elements;

determining a second highest player winning set for the player based upon the potential combination of the second set of player game elements and the first set and the second set of community game elements;

determining a second highest opponent winning set for an opponent based upon the potential combination of the second set of opponent game elements and the first set and the second set of community game elements;

determining if either the first highest player winning set, the second highest player winning set, or both, are winners with respect to the first highest opponent winning set and the second highest opponent winning set, respectively; and determining a prize for the player, if either the first highest player winning set, the second highest player winning set, or both, are winners.

2. The method of claim 1, the step of determining a first highest player winning set for the player further comprising the steps of: combining the first set of player game elements with three game elements selected from the first set of community game elements; and combining the first set of player game elements with three game elements selected from the second set of community game elements.

3. The method of claim 1, the step of determining a second highest player winning set for the player further comprising the steps of: combining the second set of player game elements with three game elements selected from the first set of community game elements; and combining the second set of player game elements with three game elements selected from the second set of community game elements.

4. The method of claim 1, the step of determining a first highest opponent winning set for the player further comprising the steps of: combining the first set of opponent game elements with three game elements selected from the first set of community game elements; and combining the first set of opponent game elements with three game elements selected from the second set of community game elements.

5. The method of claim 1, the step of determining a second highest opponent winning set for the player further comprising the steps of: combining the second set of opponent game elements with three game elements selected from the first set of community game elements; and combining the second set of opponent game elements with three game elements selected from the second set of community game elements.

6. The method of claim 1, the step of determining if either the first highest player winning set, the second highest player winning set, or both are winners further comprising the steps of: comparing the first highest player winning set with the first highest opponent winning set; and comparing the second highest player winning set with the second highest opponent winning set.

7. The method of claim 1, the step of determining a prize for the player further comprising the step of, if both the first highest player winning set and the second highest player winning set are winners, then adding a first prize associated with the first set of player game elements to a second prize associated with the second set of player game elements.

8. The method of claim 1, wherein the steps of determining winning sets are based upon the rules for a Texas Hold'em Poker styled card game.

9. The method of claim 1, further comprising steps of: covering the first set and second set of community game elements prior to the step of displaying the first set and second set of community game elements to a player; covering the first set and second set of player game elements prior to the step of displaying the first set and second set of player game elements to the player; and covering the first set and second set of opponent game elements prior to the step of displaying the first set and second set of opponent game elements to the player.

10. The method of claim 1, further comprising the steps of: revealing the first set and the second set of community game elements prior to the step of displaying the first set and the second set of community game elements to a player; revealing the first set and the second set of player game elements prior to the step of displaying the first set and the second set of player game elements to the player; and revealing the first set and the second set of opponent game elements prior to the step of displaying the first set and the second set of opponent game elements to the player.

* * * * *